US011744765B2

(12) United States Patent
Liu et al.

(10) Patent No.: US 11,744,765 B2
(45) Date of Patent: Sep. 5, 2023

(54) STANDING TRAINING MOBILE DEVICE

(71) Applicants: Chang Gung University, Taoyuan (TW); National Taiwan University of Science and Technology, Taipei (TW)

(72) Inventors: Wen-Yu Liu, Taoyuan (TW); Hen-Yu Lien, Taoyuan (TW); Chung-Hsien Kuo, Taipei (TW); Yang-Hua Lin, Taoyuan (TW)

(73) Assignees: CHANG GUNG UNIVERSITY, Taoyuan (TW); NATIONAL TAIWAN UNIVERSITY OF SCIENCE AND TECHNOLOGY, Taipei (TW)

( * ) Notice: Subject to any disclaimer, the term of this patent is extended or adjusted under 35 U.S.C. 154(b) by 310 days.

(21) Appl. No.: 16/720,391

(22) Filed: Dec. 19, 2019

(65) Prior Publication Data

US 2021/0038463 A1 Feb. 11, 2021

(30) Foreign Application Priority Data

Aug. 8, 2019 (TW) ..... 108128269

(51) Int. Cl.
*A61H 3/00* (2006.01)
*A63B 21/00* (2006.01)
(Continued)

(52) U.S. Cl.
CPC ..... *A61H 3/008* (2013.01); *A61G 5/02* (2013.01); *A61G 5/04* (2013.01); *A63B 21/00* (2013.01);
(Continued)

(58) Field of Classification Search
CPC .. A61G 5/14; A63B 21/00181; A63B 21/005; A63B 21/0083; A63B 21/0087;
(Continued)

(56) References Cited

U.S. PATENT DOCUMENTS 4,809,804 A * 3/1989 Houston ..... A61G 5/125 180/65.51
5,168,947 A * 12/1992 Rodenborn ..... B60L 15/2036 482/68

(Continued)

FOREIGN PATENT DOCUMENTS

CN 109350380 A * 2/2019 ..... A61G 5/04
CN 109568092 A 4/2019
TW I555555 B 11/2016

OTHER PUBLICATIONS

Jiang, English translation of "CN-109350380-A", February 2 019 (Year: 2 019).*

*Primary Examiner* — Tu A Vo
*Assistant Examiner* — Alexander Morales
(74) *Attorney, Agent, or Firm* — Li & Cai Intellectual Property (USA) Office

(57) ABSTRACT

A standing training mobile device for carrying a patient to perform active-assisted upright locomotion is provided. The standing training mobile device includes a base, a mobile module, a lifting module, a control module, and a support module. The mobile module and the lifting module are disposed on the base. The control module is disposed on the lifting module and is coupled to the mobile module. The control module includes a manipulation platform and two control assemblies disposed on the manipulation platform for use of the patient. The support module includes a support frame, a first support assembly, a second support assembly, and a third support assembly. The first support assembly, the second support assembly, and the third support assembly are slidably disposed on the support frame respectively. The second support assembly is disposed between the first support assembly and the third support assembly.

9 Claims, 14 Drawing Sheets

(51) Int. Cl.
*A61G 5/04* (2013.01)
*A61G 5/02* (2006.01)

(52) U.S. Cl.
CPC ..... *A61G 5/021* (2013.01); *A61G 5/024* (2013.01); *A61G 5/048* (2016.11); *A61H 2201/5025* (2013.01); *A61H 2203/0406* (2013.01); *A63B 21/00043* (2013.01)

(58) Field of Classification Search
CPC . A63B 21/068; A63B 21/159; A63B 21/4003; A63B 21/4007; A63B 21/4009; A63B 21/4011; A63B 21/4031; A63B 21/4035; A63B 21/4047; A63B 23/0405; A63B 71/0009; A63B 2022/0094; A63B 2071/0018; A61H 3/008; A61H 2203/0406; A61H 1/0229; A61H 1/0262; A61H 2201/1628; A61H 2201/1635; A61H 2201/164; A61H 2201/501; A61H 2201/5023; A61H 2201/1604; A61H 2201/019; A61H 2201/5025
USPC ..... 482/121–124, 126–127, 131, 133–134, 482/138; 601/23
See application file for complete search history.

(56) References Cited

U.S. PATENT DOCUMENTS 5,265,689 A * 11/1993 Kauffmann ..... A61G 5/042 180/65.51
5,340,139 A * 8/1994 Davis ..... A61G 5/00 280/250.1
5,366,036 A * 11/1994 Perry ..... B60L 50/66 180/65.1
5,489,258 A * 2/1996 Wohnsen ..... A61G 5/14 280/250.1
6,092,247 A * 7/2000 Wilson ..... A61G 7/1061 5/81.1 R
6,125,957 A * 10/2000 Kauffmann ..... A61G 5/14 180/65.1
6,371,228 B1 * 4/2002 Husted ..... A61G 5/1018 280/250.1
6,378,883 B1 * 4/2002 Epstein ..... A61H 3/04 180/65.6
6,540,250 B1 * 4/2003 Peterson ..... A61G 5/042 280/304.1
6,659,211 B2 * 12/2003 Esposito ..... A61G 5/1051 180/907
7,036,512 B2 * 5/2006 Harnois ..... A61G 5/128 601/24
8,215,652 B2 * 7/2012 Dashew ..... A61H 3/04 5/81.1 R
8,302,221 B1 * 11/2012 Camp, Jr. ..... A61G 7/1076 5/81.1 RP
8,567,804 B1 * 10/2013 Hoenhause ..... A61G 5/122 280/220
8,770,212 B2 * 7/2014 Alghazi ..... A61G 5/085 135/66
8,951,174 B2 * 2/2015 Huang ..... A63B 21/00196 482/142
9,289,339 B2 * 3/2016 Gray ..... B62J 9/21
10,350,448 B2 * 7/2019 Weisz ..... A63B 24/0062
2004/0267175 A1 * 12/2004 Harnois ..... A61G 5/121 602/5
2013/0219615 A1 * 8/2013 Eklof ..... A61G 7/1046 5/83.1
2015/0075575 A1 * 3/2015 Karlovich ..... A47C 1/00 135/65
2016/0058649 A1 * 3/2016 Fu ..... A63B 24/0062 482/3
2016/0213535 A1 * 7/2016 Maither ..... A61G 5/14
2018/0036189 A1 * 2/2018 Lingegard ..... A61G 7/1096
2018/0344560 A1 * 12/2018 Zheng ..... A61F 5/0123

* cited by examiner

STANDING TRAINING MOBILE DEVICE

CROSS-REFERENCE TO RELATED PATENT APPLICATION

This application claims the benefit of priority to Taiwan Patent Application No. 108128269 filed on Aug. 8, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a mobile device, and more particularly to a standing training mobile device.

BACKGROUND OF THE DISCLOSURE

Children with developmental motor delay (e.g., cerebral palsy) suffer from functional disorders and are therefore often partially or completely deprived of opportunities and experiences to play games, take care of themselves or learn things as normally developing children do in various upright activities. Such deprivations often adversely affect the children's development, academic performance, and life quality as well as that of their caregivers and parents, and such impact, in turn, leads to further deprivation of opportunities and experiences for them to play games, take care of themselves or learn things, resulting in a vicious cycle. Therefore, assistive technologies are used to help children and caregivers to break such vicious cycles, and constitute a vital part of children's rehabilitation. Many children with cerebral palsy show delays in developing the ability to stand or walk independently. Some individuals with severe conditions cannot stand or walk independently at all. Therefore, many individuals with cerebral palsy need to use assistive technologies.

Evidences in historical documents recommend that sufficient supported standing exercises with a standing frame or the like can effectively prevent the deterioration of the musculoskeletal system of a child with developmental motor delays (e.g., cerebral palsy). Therefore, it is necessary to provide children with developmental motor delays with assistive technologies for supported standing training.

Although researches have shown that devices or standing aids in assistive technologies are beneficial to children who cannot walk independently, at present, few assistive technologies are specially provided for children. As a result, children with cerebral palsy often begin to use standing or mobile aids for training after certain delays. In addition, individuals with developmental motor delay, especially infants, are forced to stand for training and may find it too boring to engage in the training if there are no pleasant diversions. At present, individuals with developmental motor delays often receive belated standing training or never receive proper standing training for many reasons (e.g., existing standing frames are usually poorly designed, infants are unwilling to cooperate, and instruments are not readily available). As a result, children with developmental motor delay keep missing opportunities to practice standing and walking independently, and their musculoskeletal system is therefore left unexercised and unfit. The physical and mental states of a patient are then trapped in such vicious cycle.

In addition, in clinical treatment and training of infants with developmental motor delays, it can still be seen that during most of the training time of sitting or standing positioning, parents push standing frames or positioning chairs, and children are not actively engaged. The infants are kept from exploring autonomously or willingly and may become dependent as time passes. As a result, the children are not properly engaged in daily activities. Moreover, most users are required to sit in existing electrical mobile devices such as wheelchairs and electrical vehicles. After sitting for a long time, the musculoskeletal system of the lower limbs of the patient may be in poor condition, causing the musculoskeletal system to deteriorate.

In view of this, standing, self-explorative moving, and upright locomotion are very important for the physical and mental wellness of children with developmental motor delay, and it is necessary to provide children with developmental motor delays with assistive technologies for active-assisted upright locomotion, including supported standing training and self-explorative moving training.

SUMMARY OF THE DISCLOSURE

In response to the above-referenced technical inadequacies, the present disclosure provides a standing training mobile device.

In one aspect, the present disclosure provides a standing training mobile device for carrying a patient to perform active-assisted upright locomotion. The standing training mobile device includes a base, a mobile module, a lifting module, a control module, and a support module. The mobile module is disposed on the base. The lifting module is disposed on the base. The control module is disposed on the lifting module and is coupled to the mobile module. The control module includes a manipulation platform and two control assemblies disposed on the manipulation platform for use of the patient. The support module is disposed on the base, and the support module and the lifting module are correspondingly disposed. The support module includes a support frame, a first support assembly, a second support assembly, and a third support assembly. The first support assembly, the second support assembly, and the third support assembly are slidably disposed on the support frame respectively. The second support assembly is disposed between the first support assembly and the third support assembly. The support frame includes a first frame body and a second frame body corresponding to the first frame body, the first frame body and the second frame body are spaced apart from each other, and a standing space for the patient to stand is provided between the first frame body and the second frame body. The first support assembly has a first abutting surface that is capable of abutting against the patient, the second support assembly has a second abutting surface that is capable of abutting against the patient, and the third support assembly has a third abutting surface that is capable of abutting against the patient.

One of the beneficial effects of the present disclosure lies in that in the standing training mobile device provided by the present disclosure, by the technical features of "the control module including a manipulation platform and two control assemblies being disposed on the manipulation platform for the patient to use" and "the support module including a support frame, a first support assembly, a second support assembly, and a third support assembly, the first support assembly, the second support assembly, and the third support assembly being slidably disposed on the support frame, respectively, and the second support assembly being disposed between the first support assembly and the third support assembly", the musculoskeletal system of a patient can be optimally developed, and can enable the patient to actively practice exploring the environment and practice coordinating two hands during supported standing.

To make the features and technical content of the present disclosure more comprehensible, the following detailed description and accompanying drawings related to the present disclosure are referred to. However, the provided accompanying drawings are only used to provide reference and description, but are not used to limit the present disclosure.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
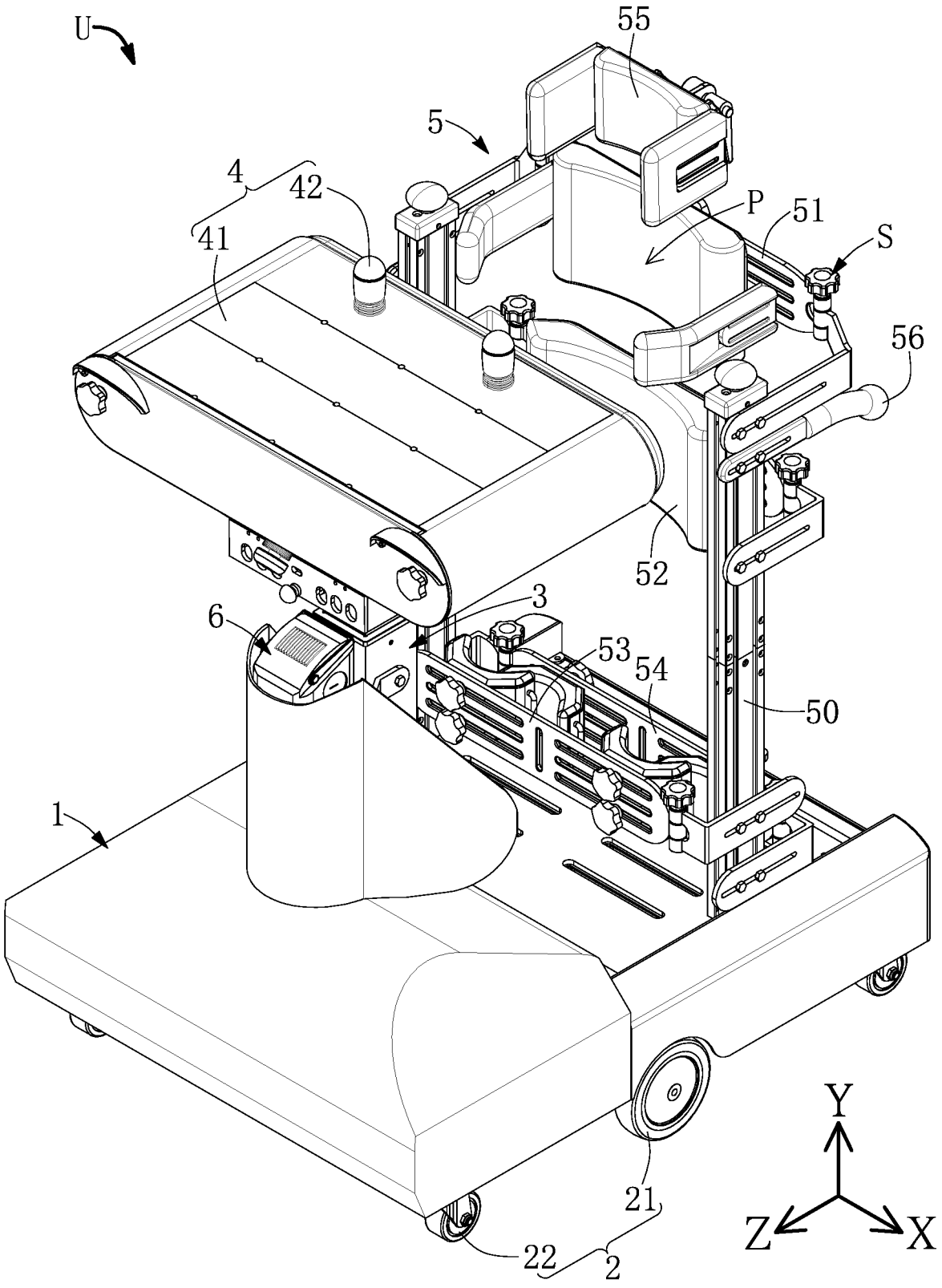
FIG. 1 is a schematic perspective view of a standing training mobile device according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
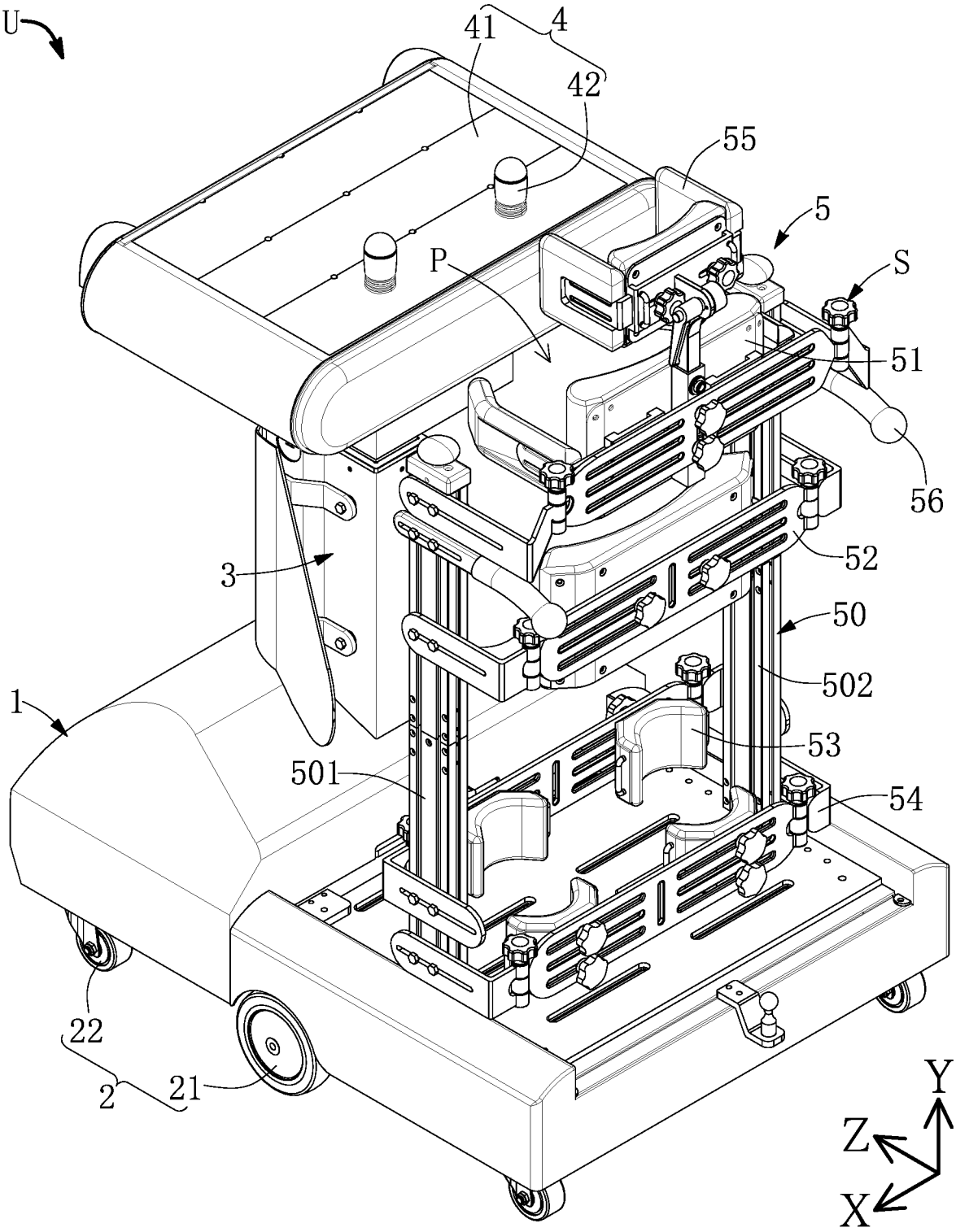
FIG. 2 is another schematic perspective view of the standing training mobile device according to the first embodiment of the present disclosure.
Figure 3:
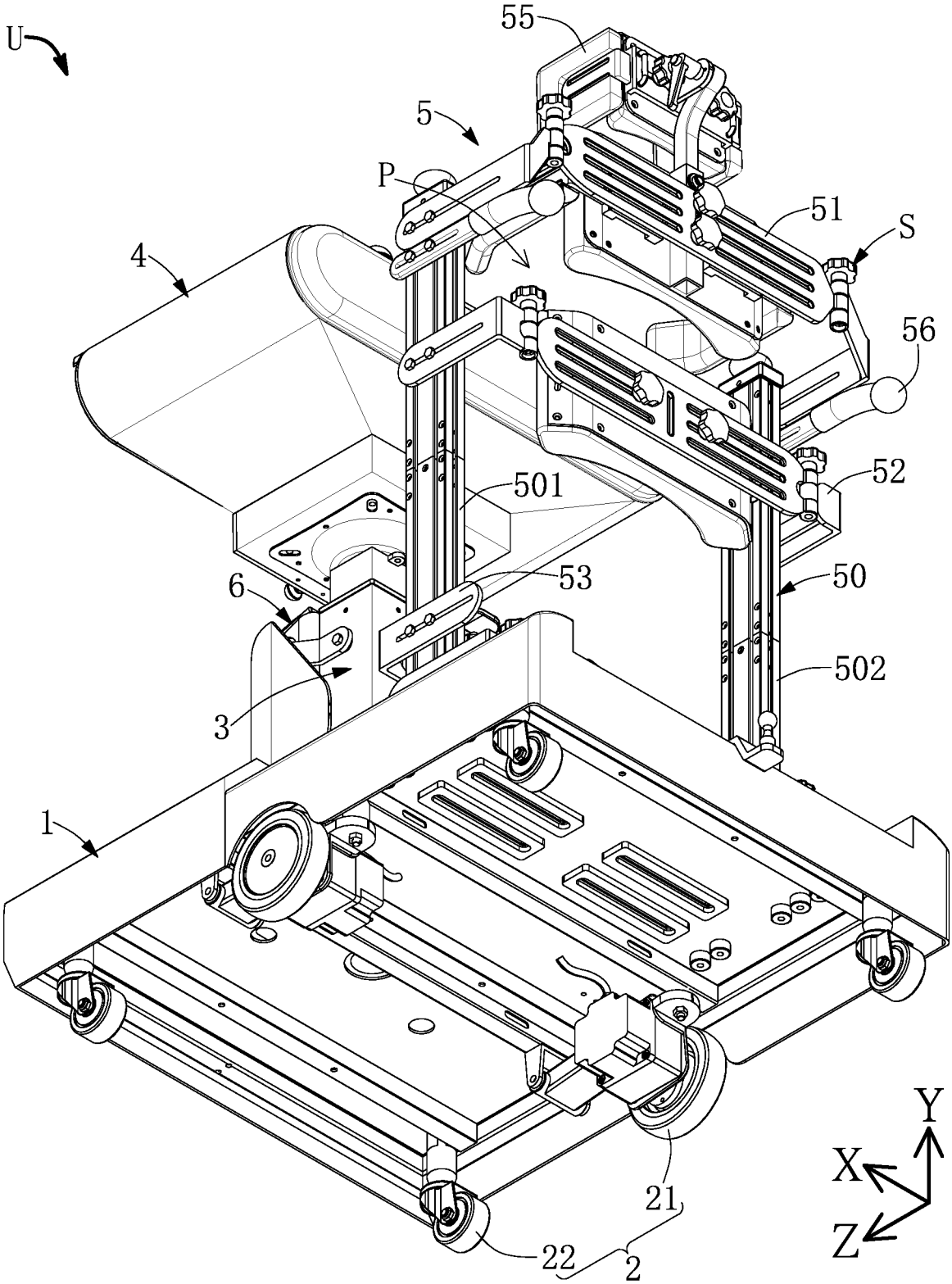
FIG. 3 is still another schematic perspective view of the standing training mobile device according to the first embodiment of the present disclosure.
Figure 4:
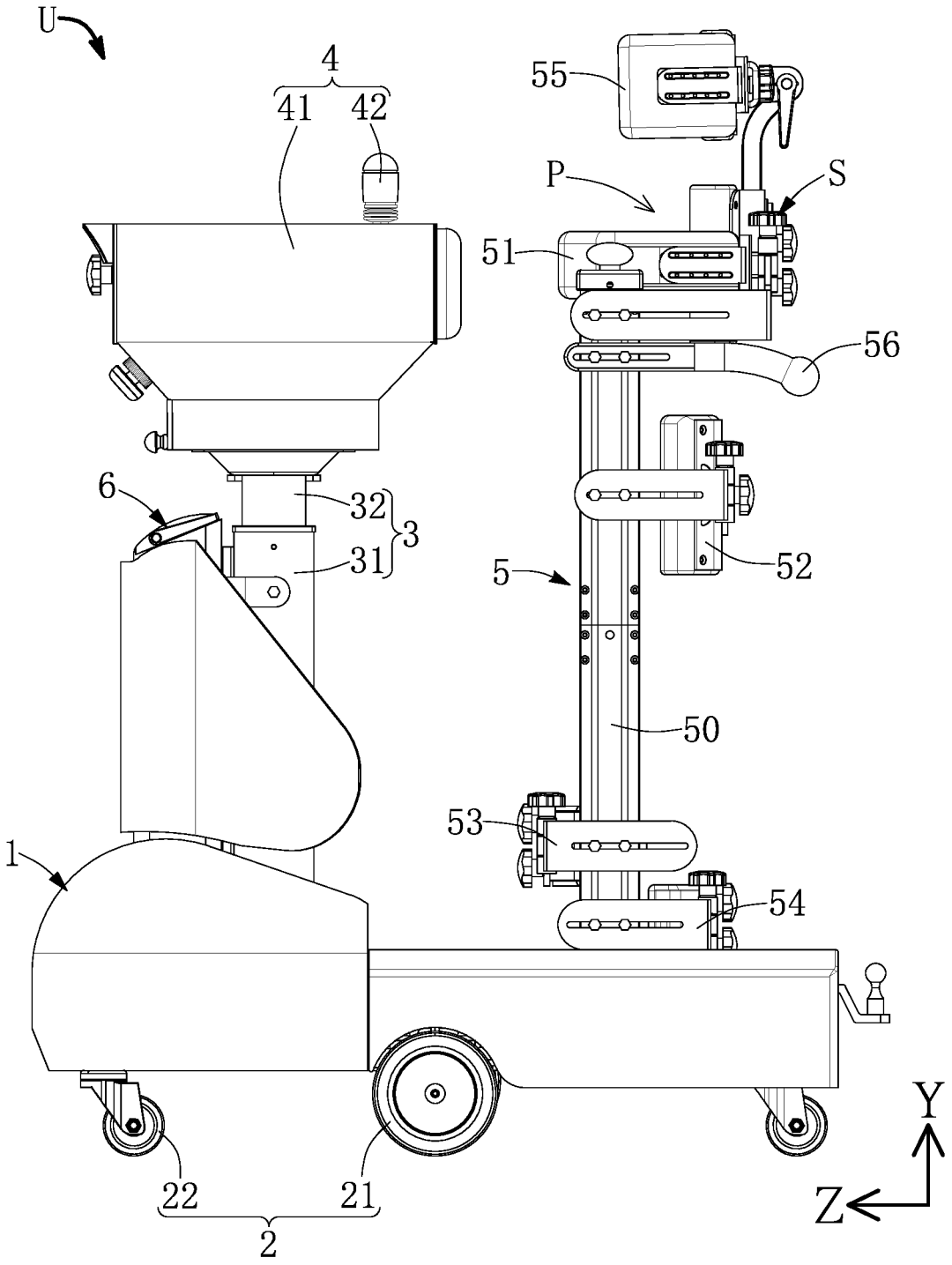
FIG. 4 is a schematic side view of the standing training mobile device according to the first embodiment of the present disclosure.
Figure 5:
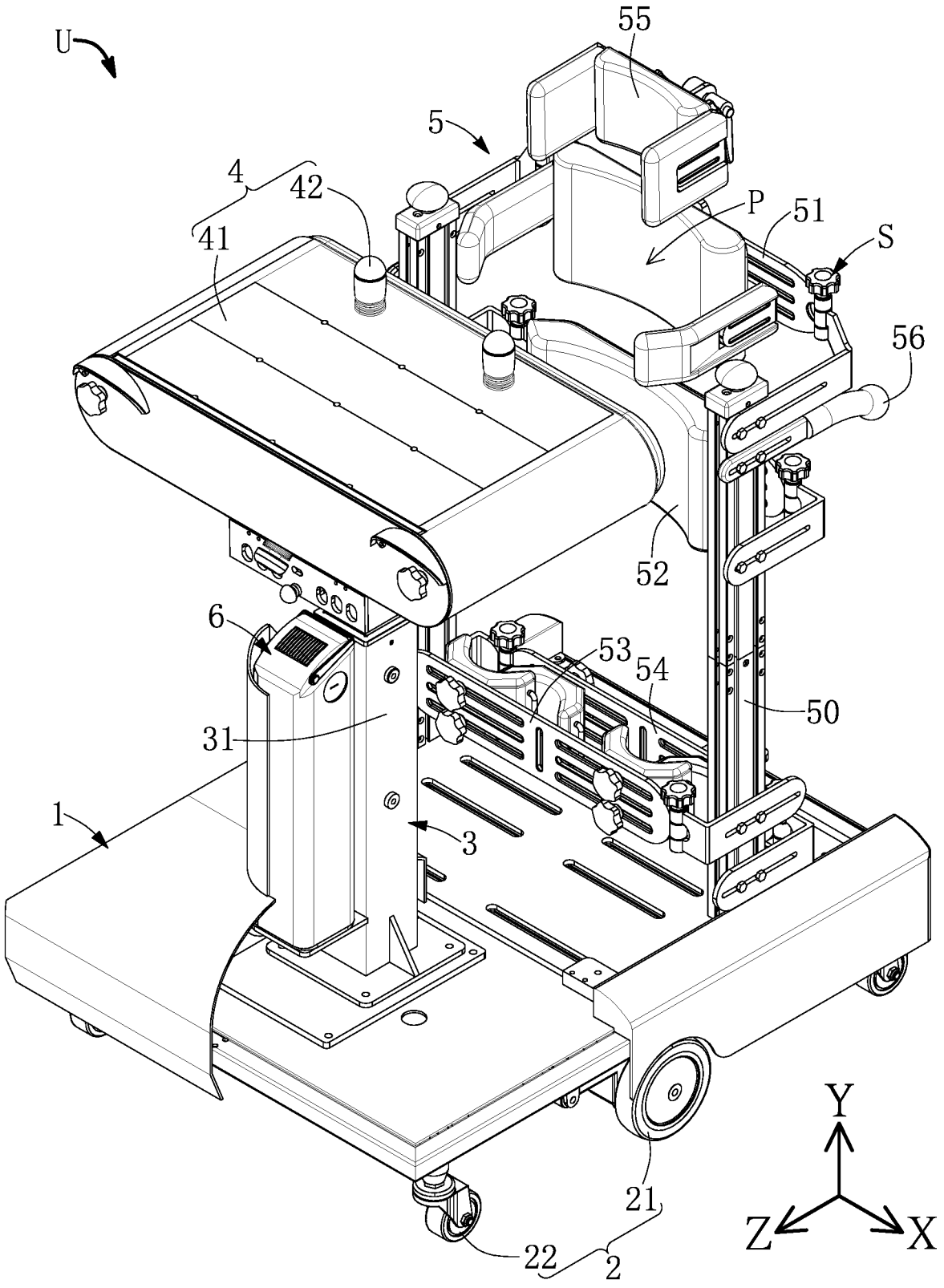
FIG. 5 is a schematic perspective sectional view of the standing training mobile device according to the first embodiment of the present disclosure.

First, referring to FIG. 1 to FIG. 4, FIG. 1 to FIG. 3 are schematic perspective views of a standing training mobile device according to a first embodiment of the present disclosure. FIG. 4 is a schematic side view of the standing training mobile device according to the first embodiment of the present disclosure. This embodiment of the present disclosure provides a standing training mobile device U for carrying a patient to perform movement. For example, the present disclosure may be preferably applicable to children with developmental delay (e.g., cerebral palsy). The standing training mobile device U may include a base 1, a mobile module 2, a lifting module 3, a control module 4, and a support module 5. In addition, the mobile module 2 and the control module 4 may be disposed on the base 1, and the control module 4 may be coupled to the mobile module 2 to control the mobile module 2. In this way, the patient can manipulate the control module 4 to drive the standing training mobile device U to perform movement. In addition, it should be particularly noted that the coupling in the entire context of the present disclosure may be direct connection or indirect connection or may be direct electrical connection or indirect electrical connection. The present disclosure is not limited thereto.

Next, the lifting module 3 may be disposed on the base 1, the control module 4 may be disposed on the lifting module 3, and the lifting module 3 can drive the control module 4 to move in a first direction (a Y direction), to adjust the control module 4 to a suitable height based on a height or posture of the patient for use of the patient. In addition, the control module 4 may include a manipulation platform 41 and two control assemblies 42 disposed on the manipulation platform 41 for the patient to use.

Next, the support module 5 may be disposed on the base 1, and the support module 5 and the lifting module 3 are correspondingly disposed. The support module 5 may include a support frame 50, a first support assembly 51, a second support assembly 52, and a third support assembly 53. The first support assembly 51, the second support assembly 52, and the third support assembly 53 are slidably disposed on the support frame 50 respectively. The second support assembly 52 may be disposed between the first support assembly 51 and the third support assembly 53. Furthermore, the support module 5 may further include a fourth support assembly 54, the fourth support assembly 54 is slidably disposed on the support frame 50, and the third support assembly 53 is disposed between the second support assembly 52 and the fourth support assembly 54. In addition, the support module 5 may further include a fifth support assembly 55, the fifth support assembly 55 is slidably disposed on the support frame 50, and the first support assembly 51 may be disposed between the second support assembly 52 and the fifth support assembly 55.

Next, the support frame 50 includes a first frame body 501 and a second frame body 502 corresponding to the first frame body 501, the first frame body 501 and the second frame body 502 are spaced apart from each other, and a standing space P for the patient to stand is provided between the first frame body 501 and the second frame body 502. In addition, the first support assembly 51, the second support assembly 52, the third support assembly 53, the fourth support assembly 54, and the fifth support assembly 55 are slidably disposed on the first frame body 501 and the second frame body 502, so that their locations can be adjusted according to a stature and status of the patient. For example, the first support assembly 51, the second support assembly 52, the third support assembly 53, the fourth support assembly 54, and the fifth support assembly 55 may move in the first direction (the Y direction, a vertical direction), so that they can be adjusted to suitable heights based on the height of the patient. In addition, the first support assembly 51, the second support assembly 52, the third support assembly 53, the fourth support assembly 54, and the fifth support assembly 55 may move in a second direction (a Z direction, a longitudinal direction), so that they can be adjusted to suitable widths based on the posture of the patient.

Next, for example, the first support assembly 51 may be an armpit support assembly, the second support assembly 52 may be a waist-hip support assembly, the third support assembly 53 may be a leg support assembly, the fourth support assembly 54 may be a foot support assembly, and the fifth support assembly 55 may be a head support assembly. However, the present disclosure is not limited thereto. In this way, the first support assembly 51, the second support assembly 52, the third support assembly 53, the fourth support assembly 54, and the fifth support assembly 55 are all used to support the patient to keep a standing gesture and fasten the patient.

Next, the support module 5 may further include an auxiliary handrail 56. The auxiliary handrail 56 may be disposed on the support frame 50. For example, the auxiliary handrail 56 may be used for the patient to change from a sitting posture to a standing posture or for another person who takes care of the patient to push the standing training mobile device U. However, the present disclosure is not limited thereto.

Next, referring to FIG. 1 to FIG. 4 again, the mobile module 2 may include at least two main driving wheels 21 and at least four auxiliary wheels 22, and the main driving wheels 21 may be disposed between the auxiliary wheels 22. For example, in the present disclosure, the two main driving wheels 21 can be controlled by the control module 4 to move according to instructions from the control module 4. For example, the control module 4 can control the main driving wheels 21 to be driven by a motor (not labeled in the figures). The auxiliary wheels 22 may not be powered. However, the present disclosure is not limited thereto. In addition, it should be noted that as shown in FIG. 4, the main driving wheels 21 may be disposed between the auxiliary wheels 22. In this way, the standing training mobile device U may be more stable during movement, and in addition, the radius of gyration of the standing training mobile device U can be reduced. In addition, for example, the main driving wheels 21 may be manipulated by the control assemblies 42 of the control module 4 to move along a straight line or make a turn.

Next, referring to FIG. 1 to FIG. 5, FIG. 5 is a schematic perspective sectional view of the standing training mobile device according to the first embodiment of the present disclosure. The standing training mobile device U may further include a power supply module 6. The power supply module 6 may be coupled to the control module 4 and/or the mobile module 2 to be used as a power source for the standing training mobile device U. In addition, for example, the power supply module 6 may be a rechargeable battery.

Next, referring again to FIG. 1 to FIG. 5, the lifting module 3 may include a seat body 31 and a lifting frame body 32 disposed on the seat body 31. The lifting frame body 32 may move in the first direction (the Y direction) relative to the seat body 31, and the manipulation platform 41 of the control module 4 may be disposed on the lifting frame body 32. In addition, for example, a hydraulic or pneumatic cylinder may be provided between the seat body 31 and the lifting frame body 32 to drive the lifting frame body 32 to perform movement. However, the present disclosure is not limited thereto. In this way, the lifting frame body 32 moves in the first direction to drive the manipulation platform 41 of the control module 4 to perform movement, so as to adjust height positions of the control assemblies 42 disposed on the manipulation platform 41 relative to the patient.

Next, for example, the two control assemblies 42 may be rocker control assemblies. However, the present disclosure is not limited thereto. In addition, it should be noted that in one of the embodiments, the two control assemblies 42 may be linked, so that the two control assemblies 42 are required to work together to drive the mobile module 2. Furthermore, the two control assemblies 42 in the present disclosure force the patient to use both hands to perform control, so that the patient can use both of the hands more frequently, thereby training both of the hands of the patient.

Figure 6:
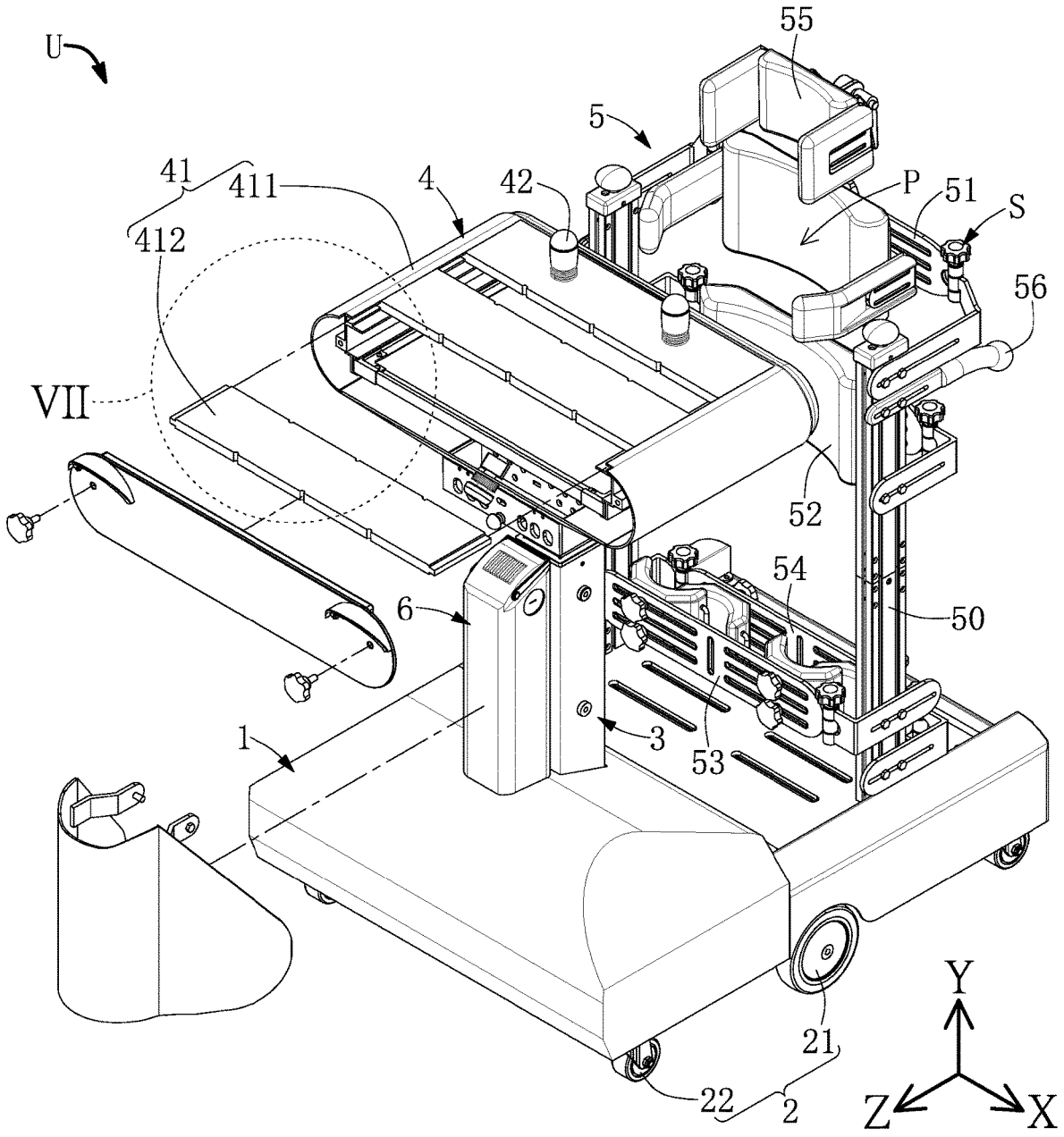
FIG. 6 is a schematic exploded perspective view of the standing training mobile device according to the first embodiment of the present disclosure.
Figure 7:
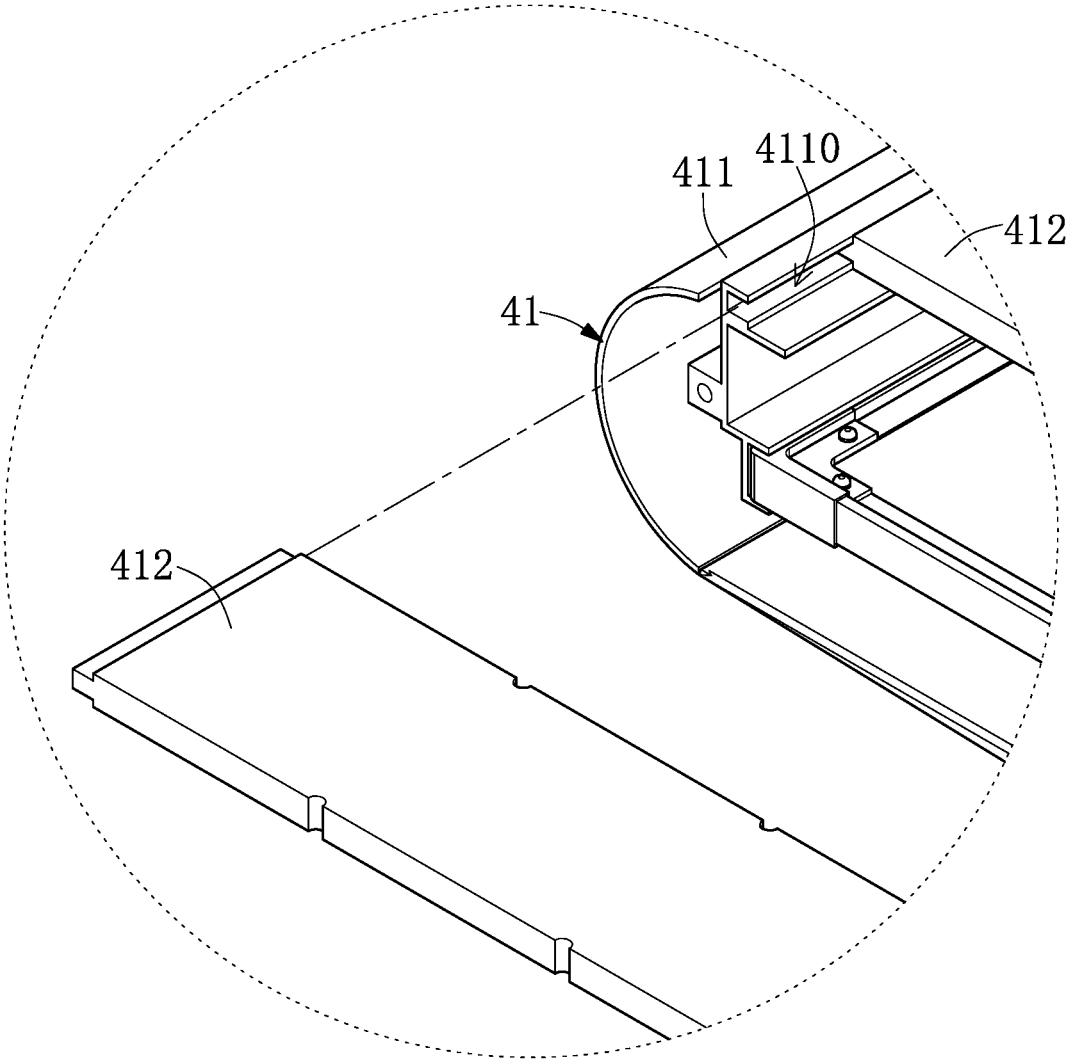
FIG. 7 is an enlarged view of a part VII of FIG. 6.
Figure 8:
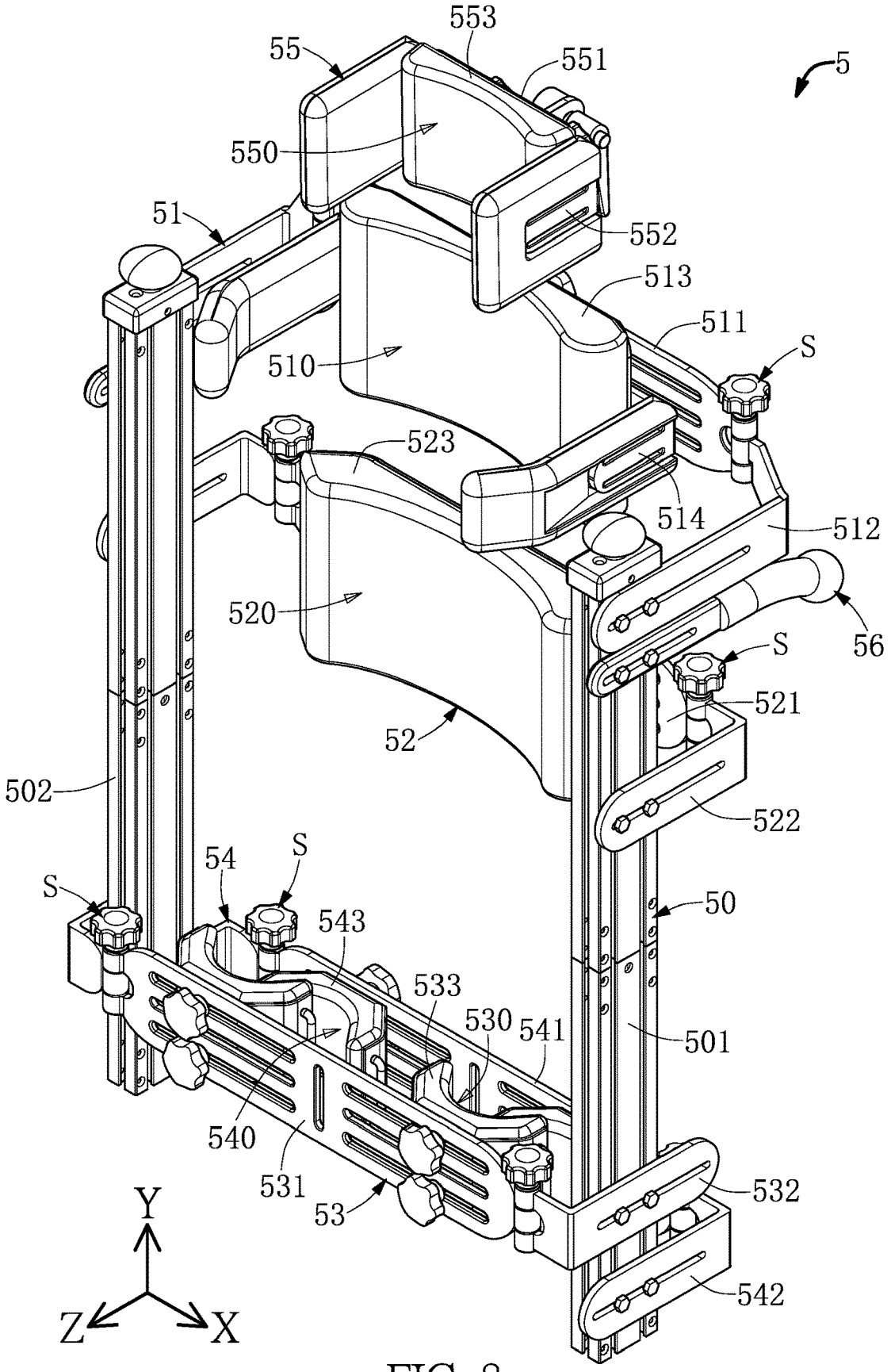
FIG. 8 is another schematic exploded perspective view of the standing training mobile device according to the first embodiment of the present disclosure.
Figure 9:
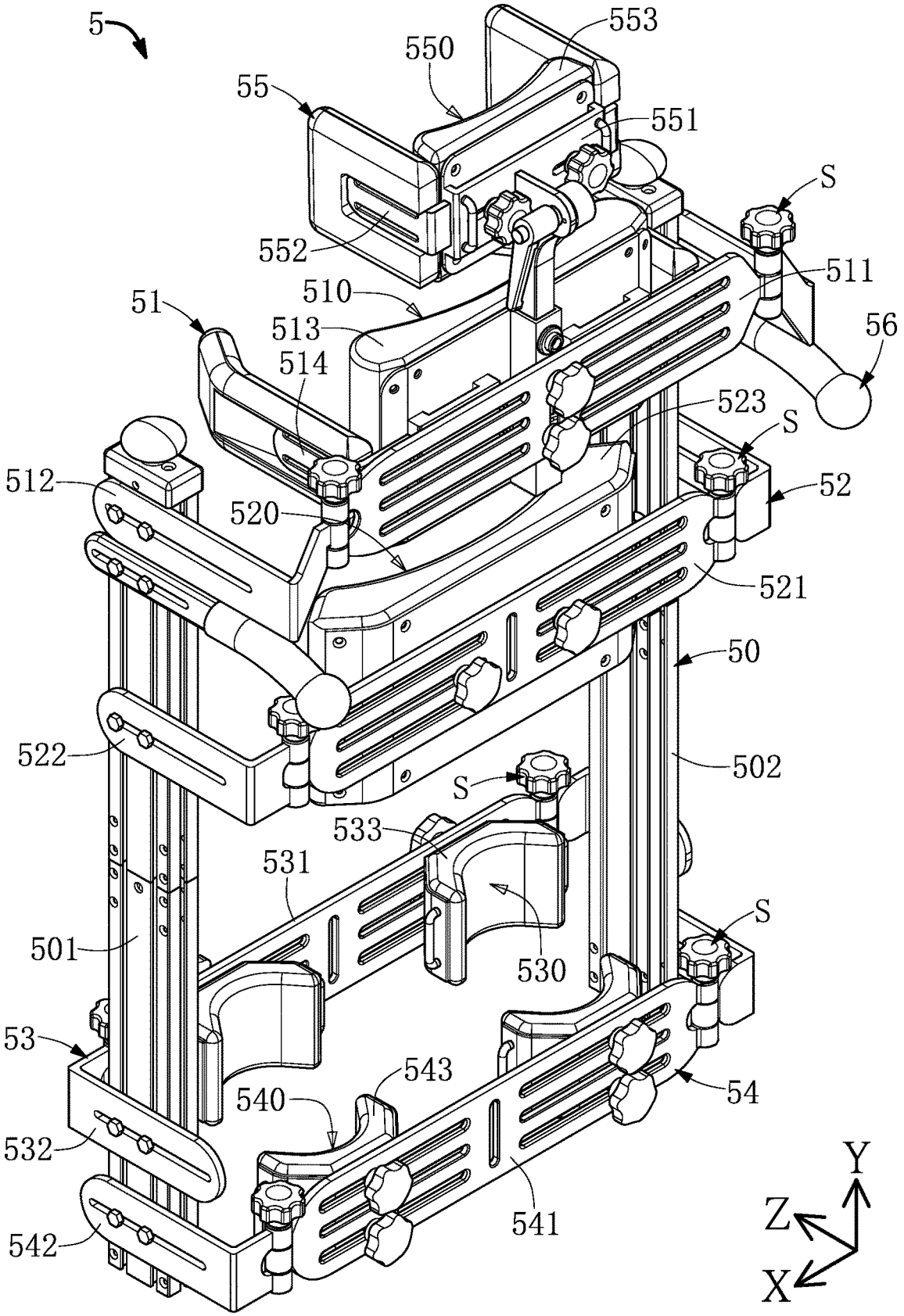
FIG. 9 is still another schematic exploded perspective view of the standing training mobile device according to the first embodiment of the present disclosure.
Figure 10:
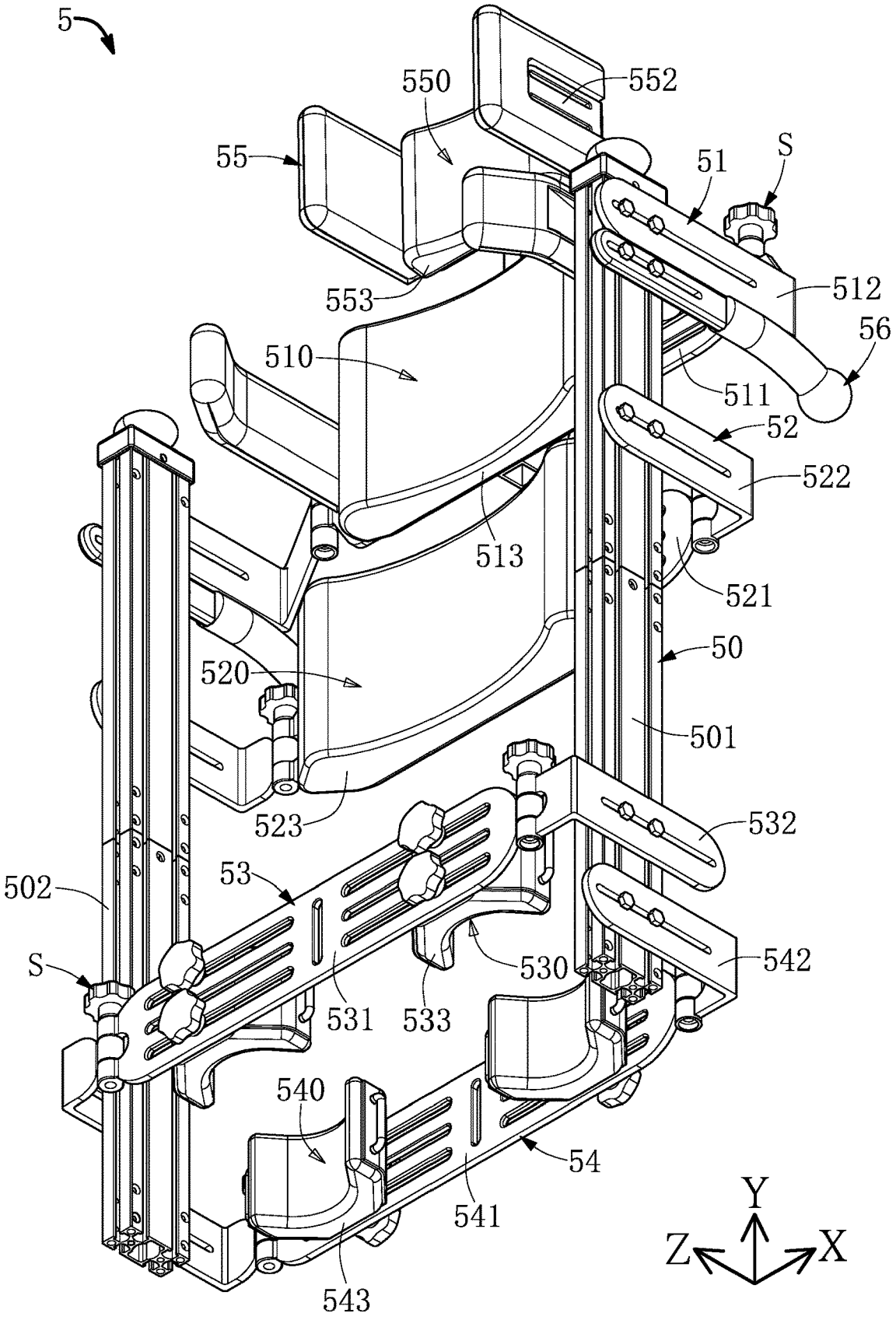
FIG. 10 is yet another schematic exploded perspective view of the standing training mobile device according to the first embodiment of the present disclosure.

Next, referring to FIG. 6 and FIG. 7, FIG. 6 is a schematic exploded perspective view of the standing training mobile device according to the first embodiment of the present disclosure. FIG. 7 is an enlarged view of a part VII of FIG. 6. The manipulation platform 41 may include a platform seat 411 and at least two carrying plates 412 slidably disposed on the platform seat 411. The two control assemblies 42 may both be disposed on one of the carrying plates 412. In addition, in this embodiment of the present disclosure, three carrying plates 412 are used as an example for description, but the present disclosure is not limited thereto. Furthermore, the platform seat 411 may include a groove 4110 corresponding to the carrying plate 412. An end portion (not labeled in the figures) of the carrying plate 412 may be disposed in the groove 4110, so that the carrying plate 412 is slidably inserted in the platform seat 411. In addition, it should be noted that the control assemblies 42 are disposed on the carrying plate 412 closest to the support module 5 in the figures. However, in other embodiments, because the carrying plate 412 is slidably disposed on the platform seat 411, the location of the carrying plate 412 provided with the control assemblies 42 may be adjusted to adjust locations of the control assemblies 42 relative to the patient. In this way, because the carrying plate 412 is detachably disposed on the platform seat 411, a location of the carrying plate 412 relative to the platform seat 411 may be adjusted, so that the carrying plate 412 mounted with the control assemblies 42 can move closer to or away from the patient, so that corresponding locations of the control assemblies are adjusted based on the hands of the patient.

Next, referring again to FIG. 1 to FIG. 4 and FIG. 8 to FIG. 10, FIG. 8 to FIG. 10 are schematic exploded perspective views of the standing training mobile device according to the first embodiment of the present disclosure. Furthermore, the first support assembly 51 may have a first abutting surface 510 that can abut the patient, the second support assembly 52 may have a second abutting surface 520 that can abut against the patient, and the third support assembly 53 may have a third abutting surface 530 that can abut against the patient. For example, in the first embodiment, the first abutting surface 510 and the second abutting surface 520 may be disposed facing the lifting module 3, and the third abutting surface 530 may be disposed facing away the lifting module 3. However, the present disclosure is not limited thereto.

Furthermore, the first support assembly 51 may include a first support bracket 511, a first positioning member 512 disposed between the first support bracket 511 and the support frame 50, and a first pad 513 disposed on the first support bracket 511. In addition, the first positioning member 512 may be disposed on the support frame 50 by a fastening member S (e.g., a knob screw, a knob nut, or another screw nut set) or a thread locking member, and locations of the first positioning member 512 and the support frame 50 may be adjusted to enable the first support assembly 51 to move in the first direction and the second direction. In addition, the first pad 513 may be a soft pad, and the first pad 513 may have the first abutting surface 510. Preferably, the first support assembly 51 may further include a support member 514 disposed on the first support bracket 511 to support the patient, and the support member 514 may be disposed on a lateral side of the first pad 513. For example, the first pad 513 may be abutted against the back of the patient, and the support member 514 of the first support bracket 511 may be used to support the patient from the armpits. However, the present disclosure is not limited thereto.

Furthermore, the second support assembly 52 may include a second support bracket 521, a second positioning member 522 disposed between the second support bracket 521 and the support frame 50, and a second pad 523 disposed on the second support bracket 521. In addition, the second positioning member 522 may be disposed on the support frame 50 by a fastening member S (e.g., a knob screw, a knob nut or another screw nut set) or a thread locking member, and locations of the second positioning member 522 and the support frame 50 may be adjusted to enable the second support assembly 52 to move in the first direction and the second direction. In addition, the second pad 523 may be a soft pad, and the second pad 523 may have the second abutting surface 520. For example, the second pad 523 may be abutted against the waist and/or hip of the patient. However, the present disclosure is not limited thereto.

Furthermore, the third support assembly 53 may include a third support bracket 531, a third positioning member 532 disposed between the third support bracket 531 and the support frame 50, and a third pad 533 disposed on the third support bracket 531. In addition, the third positioning member 532 may be disposed on the support frame 50 by a fastening member S (e.g., a knob screw, a knob nut or another screw nut set) or a thread locking member, and locations of the third positioning member 532 and the support frame 50 may be adjusted to enable the third support assembly 53 to move in the first direction and the second direction. In addition, the third pad 533 may be a soft pad, and the third pad 533 may have the third abutting surface 530. For example, the third pad 533 may be abutted against the legs (e.g., shanks) of the patient. However, the present disclosure is not limited thereto.

Next, furthermore, the fourth support assembly 54 may include a fourth support bracket 541, a fourth positioning member 542 disposed between the fourth support bracket 541 and the support frame 50, and a fourth pad 543 disposed on the fourth support bracket 541. In addition, the fourth positioning member 542 may be disposed on the support frame 50 by a fastening member S (e.g., a knob screw, a knob nut or another screw nut set) or a thread locking member, and locations of the fourth positioning member 542 and the support frame 50 may be adjusted to enable the fourth support assembly 54 to move in the first direction and the second direction. In addition, the fourth pad 543 may be a soft pad, and the fourth pad 543 may have a fourth abutting surface 540. For example, the fourth pad 543 may be abutted against the feet (e.g., the heels and/or ankles) of the patient. However, the present disclosure is not limited thereto.

Next, furthermore, the fifth support assembly 55 may include a fifth support bracket 551, a fifth positioning member 552 disposed on the fifth support bracket 551, and a fifth pad 553 disposed on the fifth support bracket 551. In addition, the fifth positioning member 552 may be disposed on the fifth support bracket 551 by a fastening member S (e.g., a knob screw, a knob nut or another screw/nut set) or a thread locking member. In addition, the fifth pad 553 may be a soft pad, and the fifth pad 553 may have a fifth abutting surface 550. Preferably, a pad (not labeled in the figures) may further be disposed on the fifth positioning member 552, and the fifth positioning member 552 may move relative to the fifth support bracket 551 to adjust the location of the pad disposed on the fifth positioning member 552. For example, the fifth pad 553 and the pad disposed on the fifth positioning member 552 may be abutted against the head and/or neck of the patient. However, the present disclosure is not limited thereto.

Figure 11:
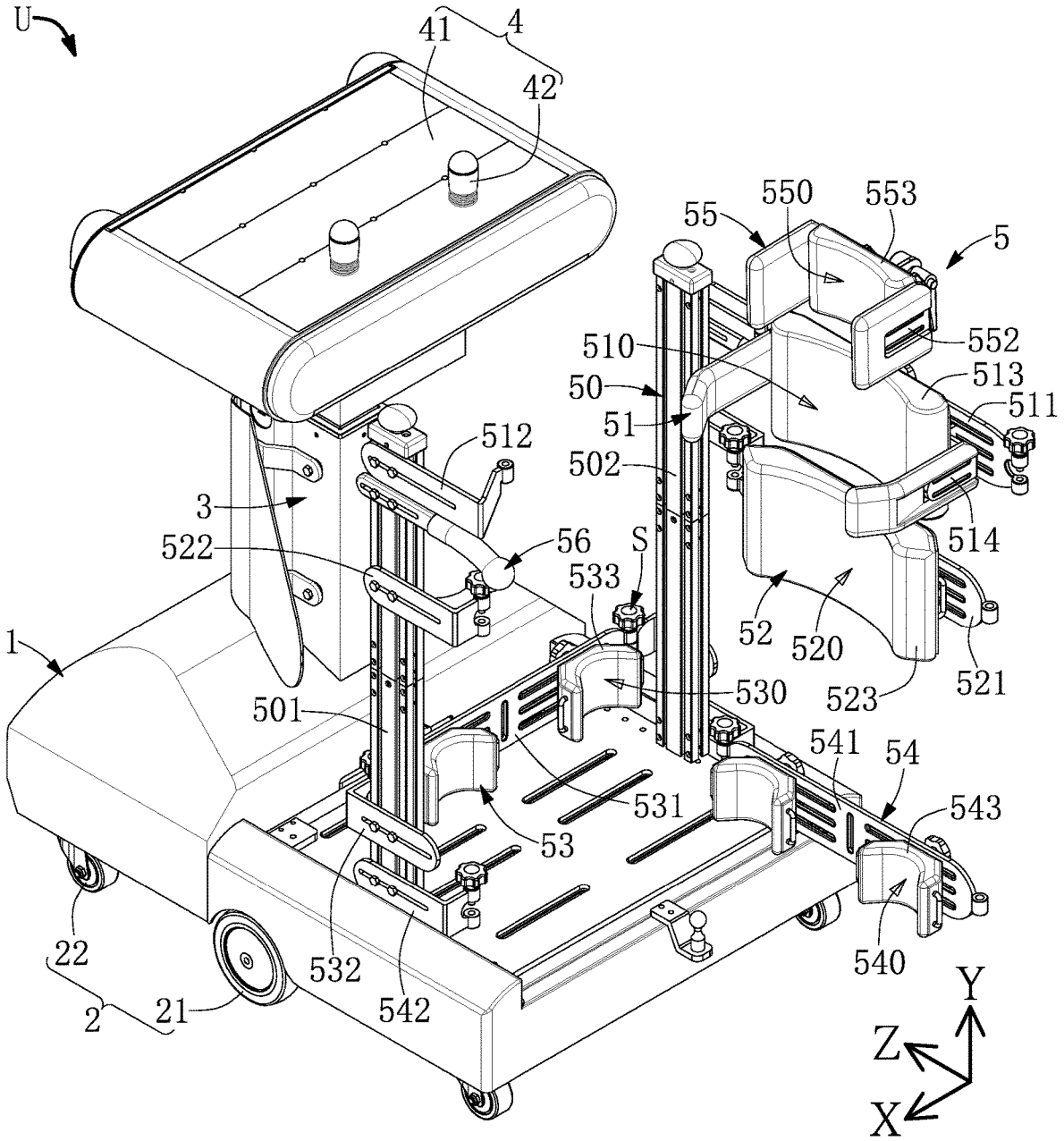
FIG. 11 is a schematic view of the standing training mobile device according to the first embodiment of the present disclosure in use.
Figure 12:
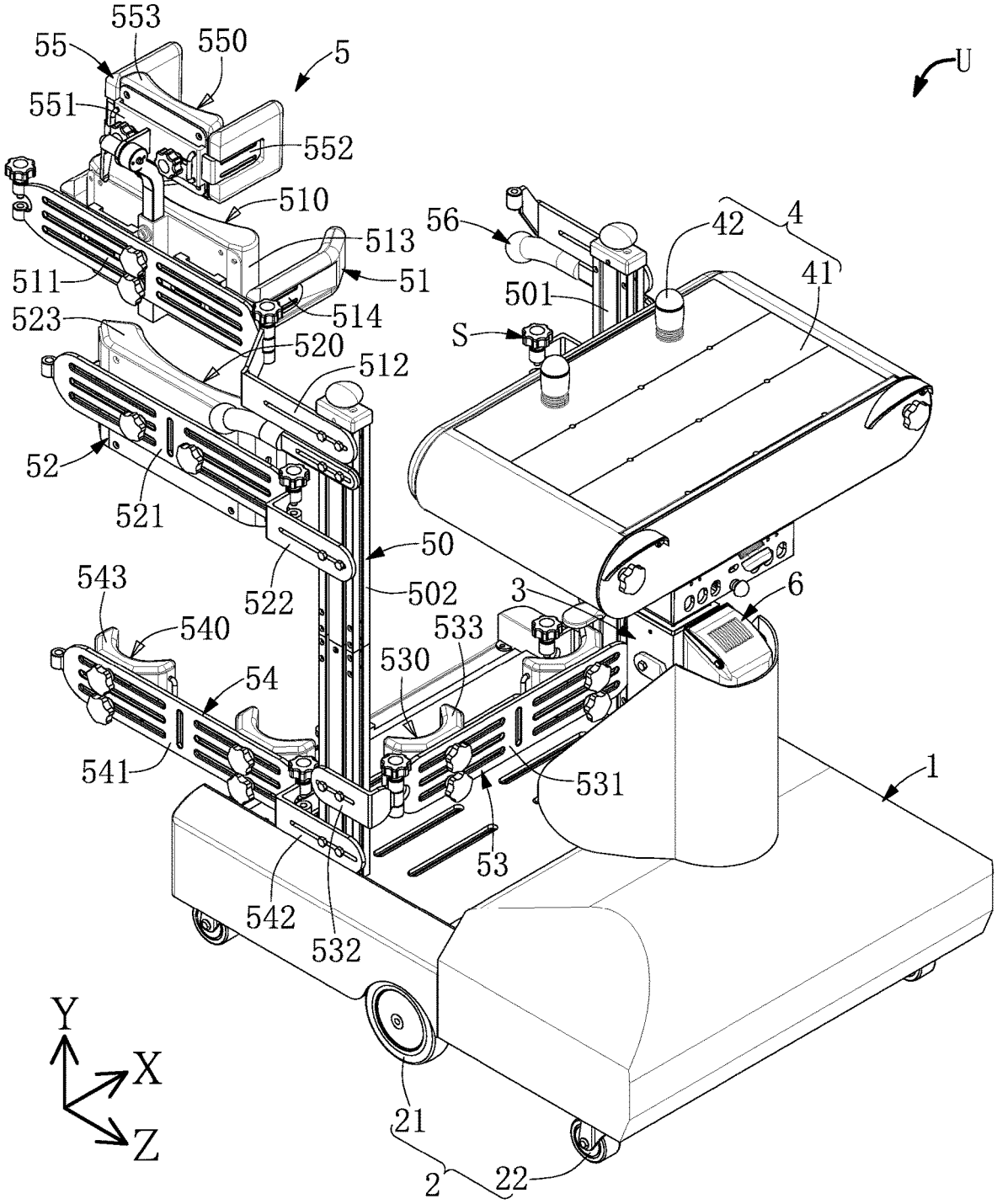
FIG. 12 is another schematic view of the standing training mobile device according to the first embodiment of the present disclosure in use.

Next, referring to FIG. 11 and FIG. 12, FIG. 11 and FIG. 12 are schematic views of the standing training mobile device in use according to the first embodiment of the present disclosure. During use, the fastening members S disposed on the first support assembly 51, the second support assembly 52, the third support assembly 53, the fourth support assembly 54, and the fifth support assembly 55 may be loosened to enable the first support bracket 511, the second support bracket 521, the third support bracket 531, the fourth support bracket 541, and the fifth support bracket 551 to rotate relative to the first frame body 501 or the second frame body 502 of the support frame 50, so that the patient can stand on the base 1. In this way, the patient can enter from behind the standing training mobile device U, so that the patient can feel more independent. In other words, the patient may move a wheel chair behind the standing training mobile device U and use a pair of auxiliary handrails 56 that are respectively disposed on corresponding support frames 50 to enter the standing space P between the first frame body 501 and the second frame body 502.

Second Embodiment

Figure 13:
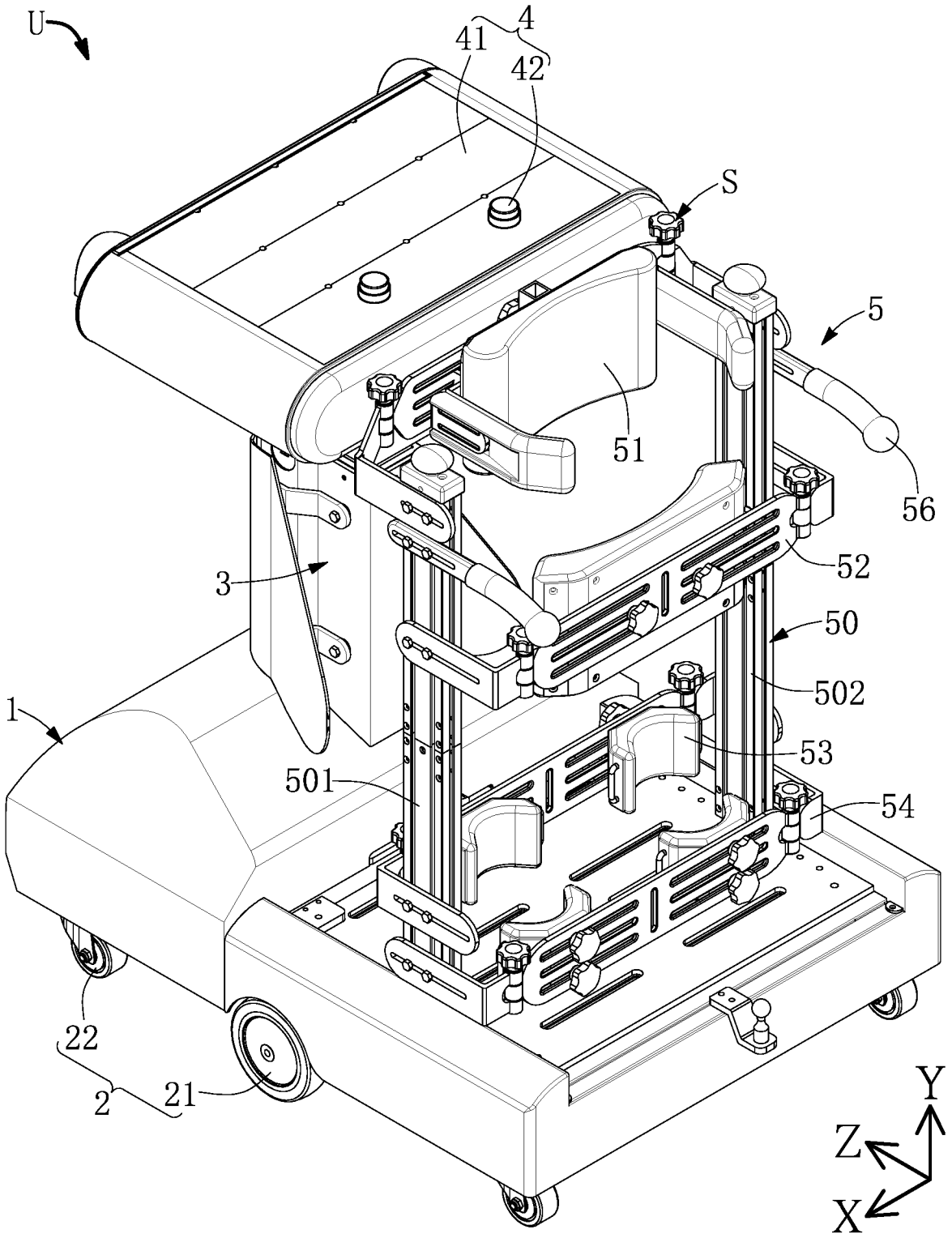
FIG. 13 is a schematic perspective view of a standing training mobile device according to a second embodiment of the present disclosure.

First, referring to FIG. 13, FIG. 13 is a schematic perspective view of a standing training mobile device according to a second embodiment of the present disclosure. From a comparison between FIG. 13 and FIG. 2, the biggest difference between the second embodiment and the first embodiment lies in that the first support assembly 51 may be disposed at a different location in the standing training mobile device U provided in the second embodiment, and the fifth support assembly 55 may be omitted in the second embodiment. In addition, it should be noted that other structural features in the second embodiment are similar to those in the description of the foregoing embodiment. Therefore, details thereof are not described herein again.

Furthermore, in the second embodiment, the first abutting surface 510 of the first support assembly 51 and the third abutting surface 530 of the third support assembly 53 may be disposed facing away from the lifting module 3, and the second abutting surface 520 of the second support assembly 52 may be disposed facing the lifting module 3. In this way, the first support assembly 51, the second support assembly 52, and the third support assembly 53 can hold a patient to secure the position of the patient. In addition, the first pad 513 may have the first abutting surface 510, and the first abutting surface 510 may be abutted against the chest of the patient.

Furthermore, in the second embodiment, the two control assemblies 42 may be press control assemblies (e.g., piezoelectric switches), and the patient may manipulate the press control assemblies to control the mobile module 2 to perform movement. However, it should be noted that feasible control assemblies in the standing training mobile device provided in the second embodiment may alternatively be the rocker control assemblies provided in the first embodiment. The present disclosure is not limited thereto. It should be noted that the rocker control assemblies and the press control assemblies may have the same insertion terminal. In this way, a caregiver may selectively mount the rocker control assemblies or the press control assemblies on the manipulation platform 41 according to the condition of the patient. In addition, it should be noted that the press control assemblies and the rocker control assemblies provided in this embodiment of the present disclosure may have the same terminal pin, so that the press control assemblies and the rocker control assemblies can be changed whenever required, thereby improving compatibility of the control assemblies 42.

Third Embodiment

Figure 14:
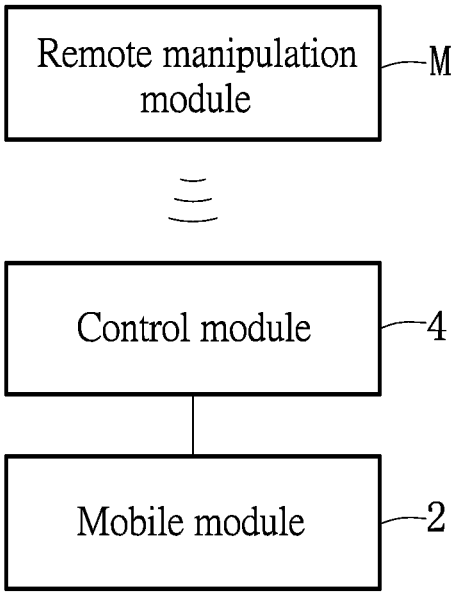
FIG. 14 is a block diagram of a standing training mobile device according to a third embodiment of the present disclosure.

Referring to FIG. 14, FIG. 14 is a block diagram of a standing training mobile device according to a third embodiment of the present disclosure. The standing training mobile device provided in the third embodiment may further include a remote manipulation module M, and the remote manipulation module M may be coupled to the control module 4 to control a movement direction of the mobile module 2. In other words, compared with the standing training mobile devices U provided in the first embodiment and the second embodiment, the standing training mobile device U provided in the third embodiment may be remotely operated by using the remote manipulation module M. In addition, the remote manipulation module M may also be applied to the first embodiment and the second embodiment, and other structural features in the third embodiment are similar to those in the description of the foregoing embodiments. Details thereof are not described herein again. In this way, a caregiver may remotely control the standing training mobile device U to perform movement.

Beneficial Effects of Embodiments

One of the beneficial effects of the present disclosure lies in that in the standing training mobile device U provided by the present disclosure, by the technical features "the control module 4 includes the manipulation platform 41 and the two control assemblies 42 disposed on the manipulation platform 41 for the patient to use," and "the support module 5 includes a support frame 50, a first support assembly 51, a second support assembly 52, and a third support assembly 53, the first support assembly 51, the second support assembly 52, and the third support assembly 53 being slidably disposed on the support frame 50, respectively, and the second support assembly 52 being disposed between the first support assembly 51 and the third support assembly 53." the musculoskeletal system of a patient (e.g., a child) can be optimally developed, and can enable the patient to actively practice exploring the environment and practice coordinating two hands during supported standing. In addition, during normal supported standing training, children can also be provided with opportunities to interact with environment without too much effort.

Furthermore, by means of the foregoing technical features, children can better develop independent mobility and social relationships and enjoy meaningful life experiences. Moreover, during supported standing training, children with developmental motor delays can actively move the upper limbs (hands) to respectively manipulate the two control assemblies 42 to manipulate the standing training mobile device U to interact with the environment. With training of both hands, children with developmental motor delays can manipulate electrical devices with more symmetrical gestures.

The descriptions above are merely exemplary embodiments of the present disclosure, but are not intended to limit the claims of the present disclosure. Therefore, any equivalent technical modifications made by using the descriptions in the specification and accompanying drawings of the present disclosure should fall within the scope of the present disclosure.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A standing training mobile device for carrying a patient to perform movement, comprising:

a base;

a mobile module disposed on the base;

a lifting module disposed on the base;

a control module disposed on the lifting module and coupled to the mobile module, wherein the control module includes a manipulation platform and two control assemblies disposed on the manipulation platform for the patient to use, the manipulation platform includes a platform seat and at least two carrying plates slidably disposed on the platform seat, and the two control assemblies are disposed on one of the carrying plates; and a support module disposed on the base, and the support module and the lifting module being correspondingly disposed and spaced apart from each other, wherein the support module includes a support frame, a first support assembly, a second support assembly, and a third support assembly, and wherein the first support assembly, the second support assembly, and the third support assembly are slidably disposed on the support frame respectively, and the second support assembly is disposed between the first support assembly and the third support assembly;

wherein the two control assemblies are linked with each other so as to force the patient to use both hands to operate the control assemblies to drive the mobile module to perform a movement;

wherein the support frame includes a first frame body and a second frame body corresponding to the first frame body, the first frame body and the second frame body are fixedly disposed on the base and spaced apart each other, and a standing space for the patient to stand is provided between the first frame body and the second frame body;

wherein the first support assembly includes a first abutting surface that abuts against the patient, the second support assembly includes a second abutting surface that abuts against the patient, and the third support assembly includes a third abutting surface that abuts against the patient.

2. The standing training mobile device according to claim 1, wherein the first abutting surface and the third abutting surface face away from the lifting module, and the second abutting surface is disposed facing the lifting module.

3. The standing training mobile device according to claim 1, wherein the first support assembly is an armpit support assembly, the second support assembly is a waist-hip support assembly, and the third support assembly is a leg support assembly.

4. The standing training mobile device according to claim 1, wherein the support module further includes a fourth support assembly, the fourth support assembly is slidably disposed on the support frame, the third support assembly is disposed between the second support assembly and the fourth support assembly, and the fourth support assembly is a foot support assembly.

5. The standing training mobile device according to claim 4, wherein the support module further includes a fifth support assembly, the fifth support assembly is slidably disposed on the support frame, the first support assembly is disposed between the second support assembly and the fifth support assembly, and the fifth support assembly is a head support assembly.

6. The standing training mobile device according to claim 1, wherein the mobile module includes at least two main driving wheels and at least four auxiliary wheels.

7. The standing training mobile device according to claim 1, wherein the support module further includes an auxiliary handrail, and the auxiliary handrail is disposed on the support frame.

8. The standing training mobile device according to claim 1, further comprising a remote manipulation module, wherein the remote manipulation module is coupled to the control module to control a movement direction of the mobile module.

9. A standing training mobile device for carrying a patient to perform movement, comprising:

a base;

a mobile module disposed on the base;

a lifting module disposed on the base;

a control module disposed on the lifting module and coupled to the mobile module, wherein the control module includes a manipulation platform and two control assemblies disposed on the manipulation platform for the patient to use, the manipulation platform includes a platform seat and at least two carrying plates slidably disposed on the platform seat, and the two control assemblies are disposed on one of the carrying plates; and a support module disposed on the base, and the support module and the lifting module being correspondingly disposed and spaced apart from each other, wherein the support module includes a support frame, a first support assembly, a second support assembly, a third support assembly, a fourth support assembly, and a fifth support assembly, and wherein the first support assembly, the second support assembly, the third support assembly, the fourth support assembly, and the fifth support assembly are slidably disposed on the support frame respectively, and the second support assembly is disposed between the first support assembly and the third support assembly;

wherein the support frame includes a first frame body and a second frame body corresponding to the first frame body, the first frame body and the second frame body are fixedly disposed on the base and spaced apart each other, and a standing space for the patient to stand is provided between the first frame body and the second frame body;

wherein the first support assembly includes a first support bracket and a first positioning member which is detachably and pivotally connected to the first support bracket and disposed on the first frame body or the second frame body of the support frame, the second support assembly includes a second support bracket and a second positioning member which is detachably and pivotally connected to the second support bracket and disposed on the first frame body or the second frame body of the support frame, the third support assembly includes a third support bracket and a third positioning member which is pivotally connected to the third support bracket and disposed on the first frame body or the second frame body of the support frame, the fourth support assembly includes a fourth support bracket and a fourth positioning member which is detachably and pivotally connected to the fourth support bracket and disposed on the first frame body or the second frame body of the support frame, the fifth support assembly includes a fifth support bracket, and the first support bracket, the second support bracket, and the fourth support bracket are respectively rotated relative to the first positioning member, the second positioning member, and the fourth positioning member to make the patient enter from behind the base and stand on the base;

wherein a back of the patient is abutted against a first pad disposed on the first support bracket, a hip of the patient is abutted against a second pad disposed on the second support bracket, a third pad disposed on the third support bracket, and ankles of the patient are abutted against a fourth pad disposed on the fourth support bracket.

* * * * *